US007990247B2

(12) United States Patent
Meinke

(10) Patent No.: US 7,990,247 B2
(45) Date of Patent: Aug. 2, 2011

(54) COIL MAGNETS WITH CONSTANT OR VARIABLE PHASE SHIFTS

(75) Inventor: Rainer Meinke, Melbourne, FL (US)

(73) Assignee: Advanced Magnet Lab, Inc, Palm Bay, FL (US)

( * ) Notice: Subject to any disclaimer, the term of this patent is extended or adjusted under 35 U.S.C. 154(b) by 0 days.

(21) Appl. No.: 12/470,328

(22) Filed: May 21, 2009

(65) Prior Publication Data

US 2009/0289753 A1 Nov. 26, 2009

Related U.S. Application Data

(60) Provisional application No. 61/055,275, filed on May 22, 2008.

(51) Int. Cl.
*H01F 27/28* (2006.01)

(52) U.S. Cl. ..... 336/222; 336/223; 336/224; 336/225

(58) Field of Classification Search ..... None
See application file for complete search history.

(56) References Cited

U.S. PATENT DOCUMENTS

| | | | | |
|---|---|---|---|---|
| 3,197,680 | A | 7/1965 | Wingerson | |
| 3,761,752 | A | 9/1973 | Anderson | |
| 4,283,687 | A | 8/1981 | Madey | |
| 4,639,708 | A | 1/1987 | Weatherly | |
| 6,566,994 | B1 * | 5/2003 | Jensen | 336/189 |
| 6,921,042 | B1 * | 7/2005 | Goodzeit et al. | 242/430 |
| 7,269,890 | B2 * | 9/2007 | Nagano et al. | 29/605 |
| 2003/0184427 | A1 | 10/2003 | Gavrilin | |

FOREIGN PATENT DOCUMENTS

| | | |
|---|---|---|
| CA | 968398 | 5/1975 |
| EP | 0353153 | 1/1990 |
| EP | 0954009 A | 11/1999 |
| FR | 2550026 A | 2/1985 |

OTHER PUBLICATIONS

Ball, MJ et al, Modulated Double Helix Quadrupole Magnets, IEEE Transactions on Applied Superconductivity, IEEE Service Center Los Alamitos CA, US vol. 13, No. 2—Jun. 1, 2003, pp. 1369-1372.
Ball, MJ et al, "The Double Helix dipole- a novel approach to Accelerator Magnet Design" IEEE Transactions on Applied Superconductivity, IEEE Service Center Los Alamitos, CA, US, vol. 13, No. 2—Jun. 1, 2003, pp. 1365-1368.

* cited by examiner

*Primary Examiner* — Anh T Mai
*Assistant Examiner* — Mangtin Lian
(74) *Attorney, Agent, or Firm* — Ferdinand M. Romano; Beusse, Wolter, Sanks, Mora & Maire, P.A.

(57) ABSTRACT

A wiring assembly having a conductor positioned about an axis in a helical-like configuration to provide a repetitive pattern which rotates around the axis. In one embodiment, when a current passes through the conductor, a magnetic field having an orientation orthogonal to the axis changes direction as a function of position along the axis.

21 Claims, 10 Drawing Sheets

COIL MAGNETS WITH CONSTANT OR VARIABLE PHASE SHIFTS

RELATED APPLICATION

This application claims priority to provisional patent application U.S. Ser. No. 61/055,275 filed 22 May 2008 which is incorporated herein by reference in the entirety.

FIELD OF THE INVENTION

This invention relates to electromagnetic systems which generate magnetic fields. More particularly, the invention relates to systems of the type including conductor assemblies which, when conducting current, generate a magnetic field or which, in the presence of a changing magnetic field, generate or transform voltages. Advancements in performance and reliability factors for conductor assemblies will create new and improved commercial applications in a wide variety of industrial arenas. For example, while it is desirable to make charged particle therapy cancer treatment (e.g., proton and carbon therapy) more available to patients, existing systems have required cyclotrons and very large magnets to steer beams of high energy charged particles. Resulting overall system size and cost severely limit the availability of these applications. Currently, the gantries used for proton therapy treatment rooms may extend multiple stories in height and weigh over one hundred tons. One impediment to further deployment of these and other charged particle beam systems is the size and cost of the beam acceleration and magnetic focusing equipment.

In the long term, for charged particle therapy and certain other high magnetic field applications, it is likely that superconducting magnets will be preferred over resistive magnets. Generally, superconducting magnets offer very stable and high field strengths and can be substantially smaller in size than resistive magnets. Moreover, the power demands of superconducting magnets are very low. However, the opportunity to provide superconducting magnets in new applications may be compromised because of the well-known quenching phenomenon. When the superconducting material undergoes an unexpected and rapid transition to a normal, non-superconducting state this can result in rapid formation of a high temperature hot spot which can destroy a magnet. Coil segments used to bend beams are very complex and must be very stable in order to implement a curved trajectory. Further, it is very difficult to apply conventional geometries, e.g., saddle coil and race track configurations, to curvilinear applications and still meet requirements for field configurations. Designs which improve reliability have been costly, imposing a major constraint to greater commercialization. See, however, U.S. patent application Ser. No. 12/061,813 which discloses manufacturing technologies suitable for superconducting magnets.

Whether future systems employ resistive or superconductive windings, a need remains to improve design efficiency, reliability, overall size and field quality. In order to deploy carbon-based systems for charged particle cancer treatment, the use of superconducting magnets may be imperative in order to meet the bending requirements of the high energy carbon beam.

Mechanical structures required to assure stabilization of conductor windings in the presence of large fields are effective, but they are also a significant factor in overall weight and system cost. With rotating machinery being subject to wear under conditions of continued use, there are also needs to reduce costly maintenance and repair. Design improvements which substantially reduce these life cycle costs and the overall affordability of high field systems can accelerate deployment of useful systems that require generation of large magnetic fields. There is a continuing need to build magnet systems which are more efficient, more compact, more robust and more reliable. Generally, it is necessary to provide wiring assemblies at lower costs in order to encourage wider uses that benefit society.

SUMMARY OF THE INVENTION

The invention relates to magnetic coils, systems comprising such coils and methods of forming and operating such coils. According to a first set of embodiments, a conductor assembly includes a length of continuous conductor positioned about an axis in a helical-like configuration to provide a sequence of interconnected and overlapping coil turns. Each turn corresponds to a different segment of the conductor and extends a full turn about the axis, with a first coil turn in the sequence overlapping a second coil turn in the sequence and entirely displaced in one direction along the axis relative to the second turn. The configuration of the conductor is such that, when conducting current, a magnetic field is generated or, when the conductor is in the presence of a changing magnetic field, a voltage is induced therein. The first and second coil turns are conductor segments, each extending 360 degrees about the axis, with the first and second coil turns connected to one another in series without any intervening segment of conductor positioned between them, thereby forming two consecutive and continuous coil turns extending at least 720 degrees about the axis. The assembly includes an aperture region extending within and through open loops of the first and second coil turns and along the axis. The configuration of the conductor enables generation of a transverse field along each of a plurality of planes passing through the axis and orthogonal to the axis, wherein direction of the transverse field, relative to the axis, varies as a function of position along the axis. In one example embodiment of the assembly the direction of the transverse field is shown to rotate about the axis as a function of position along the axis. The assembly may further include a second continuous conductor also positioned in a helical-like configuration about the axis, forming a double helix coil, to generate an axial field which cancels an axial field component generated by the other continuous conductor. Also, the conductor may comprise a sequence of fewer than ten or more than 100 interconnected and overlapping coil turns, each turn corresponding to a different segment of the conductor and extending a full 360 degree turn about the axis, with each coil turn in the sequence overlapping an adjoining coil turn in the sequence and entirely displaced in one direction along the axis relative to the adjoining turn. In one example, conductors having helical-like configuration each include a plurality of adjoining coil turns forming a continuous sequence of loops about the axis according to a series of point transformations from X, Y, Z to into points $X_P$, $Y_P$, $Z_P$, based on Equations 3 and 5 set forth herein. Also, the assembly is described as including a straight axis about which the conductor is formed but the axis may be curved.

In a second set of embodiments, an assembly comprises a conductor positioned about an axis in a helical-like configuration to provide a sequence of coil turns, with each coil turn partially overlapping an adjoining coil turn in the sequence. The configuration includes a periodic pattern which rotates about a portion of the axis as a function of position along the axis. In one example, when a current passes through the conductor, a transverse field is generated in directions orthogonal to the axis with direction of the transverse field varying about the axis as a function of position along the axis. Also, when a current passes through the conductor, the direction of the transverse field may rotate about the axis as a function of position along the axis. Further, the assembly may be configured as a rotating machine having a stator and a rotor operatively positioned to generate a magnetic field or induce a voltage, wherein the stator and rotor each comprise a conductor positioned about an axis in a helical-like configuration to provide a sequence of coil turns. Each coil turn partially overlaps an adjoining coil turn in the sequence, and the configuration includes a periodic pattern which rotates about a portion of the axis as a function of position along the axis. In one more specific example, the assembly is characterized in that when a current passes through one of the conductors, a transverse field is generated in directions orthogonal to the axis about which that conductor is positioned, with direction of the transverse field varying about the axis about which that conductor is positioned as a function of position along the axis. In another example, the assembly is characterized in that when a current passes through the conductor of the stator, a transverse field is generated in directions orthogonal to the axis about which that conductor is positioned with direction of the transverse field varying about the axis about which that conductor is positioned as a function of position along the axis, and when a current passes through the conductor of the rotor, a transverse field is generated in directions orthogonal to the axis about which that conductor is positioned with direction of the transverse field varying about the axis about which that conductor is positioned as a function of position along the axis.

In a third set of embodiments, also according to the invention, a conductor assembly includes a layer and a conductor positioned in a path formed in the layer, with the path revolving about an axis in a helical-like configuration wherein a pattern is formed in the conductor path, which pattern rotates about the axis as a function of position along the axis. In one example of such, when a current passes through the conductor, a transverse field is generated in directions orthogonal to the axis such that the direction of the transverse field rotates about the axis as a function of position along the axis. In another example, along a series of points on a portion of the axis, the transverse field rotates about the axis at a constant rate in proportion to change in position of the conductor path along the axis. The stator may include a plurality of pairs of conductors in a helical-like configuration with members of each pair having opposite tilt angles to substantially cancel axial field components so that when conducting current the assembly predominantly generates only axial field components.

According to a fourth set of embodiments, a conductor assembly includes a conductor positioned about an axis in a helical-like configuration to provide a repetitive pattern which rotates around the axis. For example, when a current passes through the conductor, a magnetic field having an orientation orthogonal to the axis changes direction as a function of position along the axis.

According to a fifth set of embodiments, a conductor assembly includes a magnetic coil positioned about an axis. The assembly is of the type which, when conducting current, generates a magnetic field or which, in the presence of a changing magnetic field, induces a voltage. The coil includes a conductor occupying a spiral-like configuration around the axis capable of generating a field transverse to the axis when current flows through the conductive material. The spiral-like configuration includes a section of continuous conductor forming a first continuous sequence of loops about the central axis according to a series of point transformations from X, Y, Z to $X_P$, $Y_p$ and $Z_p$ based on Equations 3 and 5 herein.

According to another set of embodiments, a conductor assembly includes a magnetic coil positioned about an axis which, when conducting current, generates a magnetic field or which, in the presence of a changing magnetic field, induces a voltage. The coil has a spiral-like configuration, including a pattern which rotates about the axis as a function of position along the axis. The assembly generates a field transverse to the axis when current flows through the coil. The configuration is a periodic pattern about the axis with features including: an X dependence on $[h/(2\pi)]\theta$ and $A_n \sin(n\theta)$; a Y dependence on $R\cos(\theta)$ and a Z dependence on $R\sin(\theta)$, with the pattern having a monotonically increasing phase shift about the axis as a function of distance along the axis. In one example, the spiral-like configuration includes a section of continuous conductor forming a first continuous sequence of loops about the central axis according to Equations 3 herein.

According to still another set of embodiments, a conductor assembly comprises one or more lengths of conductor, each positioned about a common axis in a helical-like configuration, the assembly being of the type which, when conducting current, generates a magnetic field or which, in the presence of a changing magnetic field, induces a voltage. When conducting current the assembly generates a transverse field along each in a plurality of planes passing through the common axis and orthogonal thereto. The direction of the transverse field, relative to the common axis, varies as a function of distance along the common axis.

Figure 1:
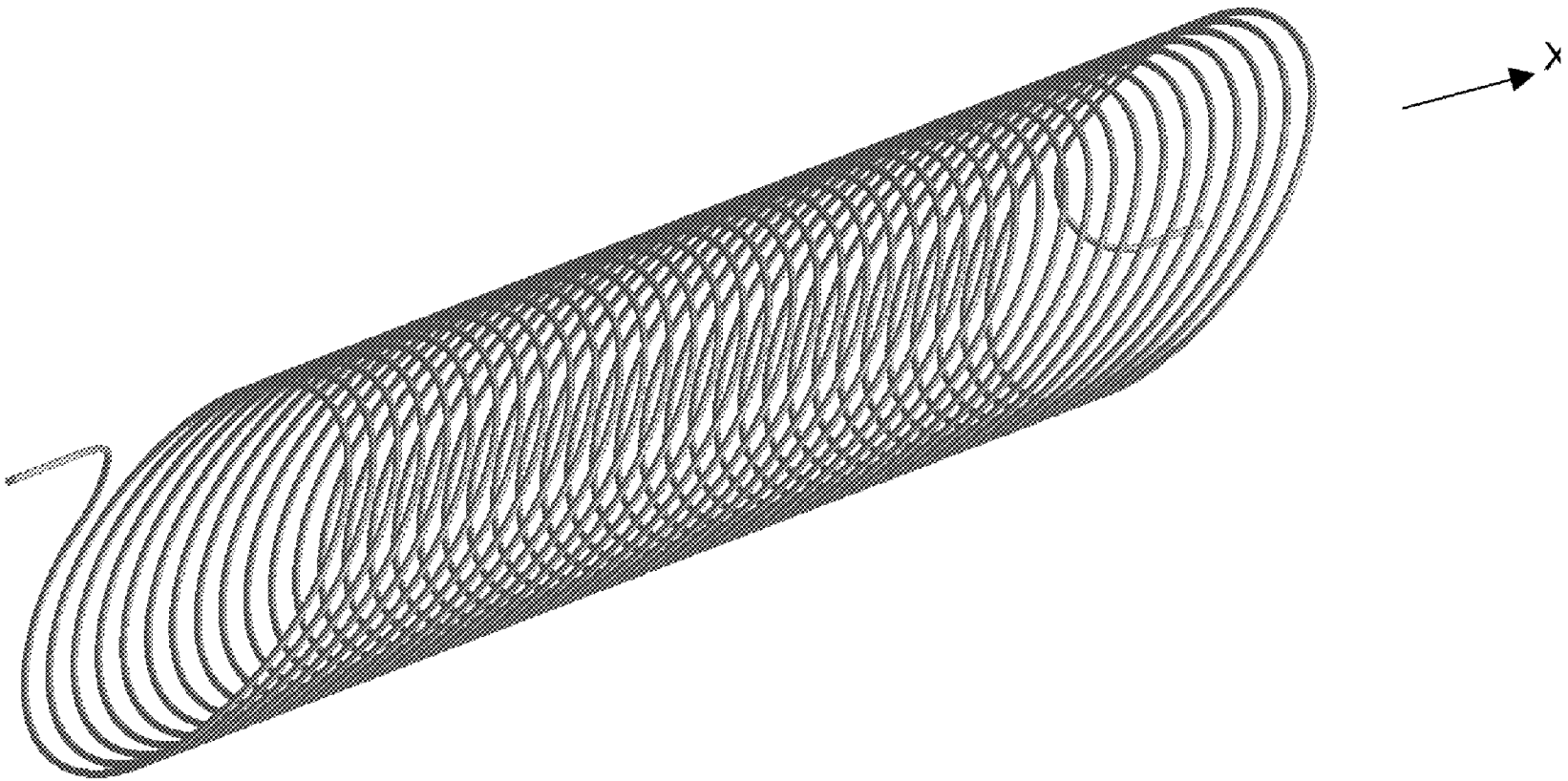
Figure 1 Prior Art
FIG. 1 is a partial perspective view of a conductor having a regular helical geometry as may be used to form prior art double helix coil pairs suitable for generating a dipole field.

Like reference numbers are used throughout the figures to denote like components. Numerous components are illustrated schematically, it being understood that various details, connections and components of an apparent nature are not shown in order to emphasize features of the invention. Various features shown in the figures are not shown to scale in order to emphasize features of the invention.

DETAILED DESCRIPTION OF THE INVENTION

Before describing in detail particular methods and apparatuses related to embodiments of the invention, it is noted that the present invention resides primarily in a novel and non-obvious combination of components and process steps. So as not to obscure the disclosure with details that will be readily apparent to those skilled in the art, certain conventional components and steps have been omitted or presented with lesser detail, while the drawings and the specification describe in greater detail other elements and steps pertinent to understanding the invention. Further, the following embodiments are exemplary and not limiting as to structures, designs or methods according to the invention, and these examples describe features that are permissive rather than mandatory and that are illustrative rather than exhaustive.

As used herein, the terms coil, spiral, helix and helical include but are not limited to regular geometric patterns. In addition, the terms coil, spiral and helix include configurations wherein a width (e.g., along the axial direction) or a thickness (e.g., along a radial direction or transverse to the axial direction) may vary. Contemplated embodiments include variations which depart substantially from regular geometries and which therefore may not be simply described in closed form. Numerical solutions, proximate as they may be, can be applied to model and design wiring configurations which may then be constructed accordingly to a desired level of precision. Further, terms such as winding, helical winding, wiring pattern and coil configuration as applied to physical embodiments formed of various conductor and/or insulative materials, are used without regard to how the materials are formed in place. That is, although it is conventional to physically wind a strand of conductor in the configuration of a spiral, the foregoing terms as used herein refer to the resulting configuration and not the methodology used to form the pattern. So, for example, a coil or winding may be formed from a cylindrical body by removal of body material, this resulting in a shape that corresponds to a spiral winding. In addition, the void resulting from the removal of material may also correspond to a spiral shape.

With coils helically-wound about an axis to produce magnetic field components transverse to the axis, cancellation of axial field components can be effected by the formation of coils in concentrically positioned pairs having opposite tilt angles, this sometimes resulting in a high quality transverse field, e.g., a uniform dipole with essentially no higher order components. See, for example, Goodzeit et al., "The Double-Helix Dipole—A Novel Approach to Accelerator Magnet Design", *IEEE Transactions on Applied Superconductivity*, Vol. 13, No. 2, June 2003, pp. 1365-1368, which describes analytics for a double helix magnet geometry. See, also, U.S. Pat. No. 6,921,042,B1, now incorporated herein by reference, for "Concentric Tilted Double-Helix Dipoles and Higher-Order Multipole Magnets", issued Jul. 26, 2005 and referred to herein as the '042 Patent. The '042 Patent discloses straight magnets, i.e., magnetic coils formed along straight axes, of arbitrary multipole order (dipole, quadrupole, sextupole, etc.) with fields that are constant along the magnet axis. The inventive concepts disclosed herein may be practiced in conjunction with the design and manufacturing concepts disclosed in co-pending U.S. patent application Ser. No. 12/061,813 "Wiring Assembly and Method of Forming A Channel In A Wiring Assembly For Receiving Conductor" filed Apr. 3, 2008, now incorporated herein by reference; and may also be practiced in conjunction with the design and manufacturing concepts disclosed in co-pending U.S. patent application Ser. No. 12/388,306, "Helical Coil Design and Process for Direct Fabrication From a Conductive Layer" filed 18 Feb. 2009, assigned to the assignee of the present invention and incorporated herein by reference. Applications according to the present invention as described here are based in part on the '042 Patent.

For many conventional, helically wound conductors and other magnet geometries, some of these being racetrack and saddle configurations, placement of conductor has been problematic for multiple reasons. For example, in windings formed with circular-shaped cable, turns typically build on one another with a second row of turns being tightly wound over a previously wound row of turns. In these prior systems the position and stability of the conductor has depended on the ability to maintain the conductor in a static position during manufacture, assembly, and operation, i.e., under typical thermal cycling and high Lorentz forces acting during coil excitation. As shown in Ser. No. 12/061,813, it is possible to more fully utilize other wiring patterns, without compromising reliability, by separating all of the rows of conductor segments with intervening insulative layers and pre-defining the wiring patterns with channels formed in the insulative layers. Such formation of channels into which the conductor coil or winding is inserted provides precise conductor positioning and stabilization while also isolating portions of the conductor from other portions of the conductor. Conductors having square or rectangular shapes in cross section, or tape, can be used in conjunction with channels. The conductor pattern and the corresponding channel path can be formed in a relatively tight helical configuration wherein h, the advance per turn in an axial direction, is so small that portions of the conductor in adjacent turns come very close or into contact with one another. In embodiments where contact between adjacent portions of conductor turns is a concern, the conductor has an insulative coating.

The term "conductor" as used herein refers to a string-like piece or filament of relatively rigid or flexible material, commonly referred to as cable or wire, being of the type comprising either a single conductive strand or multiple ones of such strands grouped together as one functional conductive path. The term multi-strand conductor refers to such a conductor formed as a single identifiable unit and composed of multiple conductive strands which may be twisted, woven, braided or intertwined with one another to form an identifiable single unit of wire. Multi-strand conductor may take the form of conductor that embodies a circular or a non-circular cross section.

The term cross section refers to a section of a feature, e.g., of a conductor or an aperture or a coil, taken along a plane which is transverse to a definable axis through which the feature extends. If the coil row axis is curvilinear about a point of interest on the axis, the plane along which the cross section is taken is understood to be transverse to the direction of a vector which is tangent to the direction of the axis at the point of interest.

A simple prior art spiral pattern for a coil-shaped conductor in three-dimensional space is generated in accord with the relationships of Equations 1A, 1B and 1C:

$$X(\theta)=[h/(2\pi)]\theta \quad 1A$$

$$Y(\theta)=R\cos(\theta) \quad 1B$$

$$Z(\theta)=R\sin(\theta) \quad 1C$$

wherein the X coordinate is along a longitudinal direction parallel with an axis of symmetry and the Y and Z coordinates are along directions transverse to the axis of symmetry and orthogonal to one another. θ is the azimuthal angle measured in a Y-Z plane transverse to the X-axis. The parameter h defines the advance per turn in the X direction. R is the radius of the aperture of the winding pattern. That is, for embodiments having a regular shape, R corresponds to a radial distance from an axis of symmetry to a point on the curve, and the aperture is the volume within the shape formed by the helical pattern.

Three-dimensional space curves for individual coils found in prior art double helix coil pairs may be regular helical geometries generated in accord with the relationships of Equations 2A, 2B and 2C:

$$X(\theta)=[h/(2\pi)]\theta+A_n\sin(n\theta) \quad 2A$$

$$Y(\theta)=R\cos(\theta) \quad 2B$$

$$Z(\theta)=R\sin(\theta). \quad 2C$$

The term $A_n$ sin(nθ), in the X(θ) equation, is a modulating component which imparts a positive or a negative tilt to each of the turns relative to the Y-Z plane, in proportion to the magnitude and sign of the term $A_n$. According to the value of n, the term $A_n$ sin(nθ) also introduces a modulation, i.e., a sinusoidal variation, in each 360 degree turn of the curve about the axis. For n=1, an ellipsoidal shape is imparted to each turn, this defining the coil-shaped conductor pattern shown in FIG. 1, suitable for generating a dipole field. See, also, the '042 Patent. The more complex pattern shown in FIG. 2, having a sinusoidal component corresponding to n=2, is suitable for generating a quadrupole field. For higher values of n, still higher frequency sinusoidal components modulate the shape of each turn.

As can be seen from FIG. 1, with addition of the $A_n$ sin(no) term and with n=1, the coil turns include a tilt relative to planes orthogonal with the illustrated X axis. This results in a significant component of current flow in the axial direction. A transverse magnetic field is therefore generated together with an axial field component. Transverse in this context denotes components of magnetic fields only in planes transverse to the major axis along which the conductor is formed. In a Cartesian coordinate system this may correspond to a helical coil formed along an X axis as an axis of symmetry and the transverse field components being in YZ planes. With incorporation of a second layer of turns and with the two patterns having opposite tilt angles relative to the YZ-plane (by providing the terms $A_n$ in each of the two coils with opposite signs), it is possible to generate a substantially pure transverse field and practically eliminate the axial field component. Pairs of coil windings wherein individual patterns in the pair having opposite tilts, i.e., for the same values of n, are referred to in the literature as double-helix windings. See, again, the '042 Patent.

Still, more generally, for several embodiments of the invention, a three-dimensional space curve may be generated in accord with the equations 3A, 3B and 3C:

$$X(\theta)=[h/(2\pi)]\theta+\Sigma A_n\sin(n\theta+\phi_n) \quad 3A$$

$$Y(\theta)=R\cos(\theta) \quad 3B$$

$$Z(\theta)=R\sin(\theta) \quad 3C$$

wherein $A_n$ determines the amplitudes of modulation in equation 3A, and $\phi_n$ determines phase shifts between the sinusoidal components. Generally, $A_n$ may be a function of θ, X(θ), Y(θ) or Z(θ), i.e., $A_n$=f(θ, X(θ), Y(θ), Z(θ)). R determines the radius of the winding pattern, which is measured from the axis of the cylindrically shaped coil and θ is the azimuth angle. In this context the term coil and the adjective helix refer to a variety of spiral-like shapes which can result from the aforedescribed function, understanding that other trigonometric or numerical expressions may be used to define the channel path and the conductor path. The individual or combined content of the fields corresponding to one or more values of n are generally referred to as multipole components. Field components generated from a double-helix winding configuration, and corresponding to different values of n according to equation 3 are substantially or entirely orthogonal with one another. For a pure dipole field the summation over multiple modulations is limited to one term, i.e., n=1, wherein the coil pattern forms a helical configuration in which the individual turns are tilted with respect to the transverse Y-Z plane. This tilt angle α is determined by the amplitude $A_1$. When $A_1$ equals R the resulting tilt angle, α, is 45 degrees and increases with the size of the amplitude.

An individual layer of a double-helix coil simultaneously generates transverse and axial magnetic fields. As used herein, double-helix coil means a pair of conductor coils each configured in accord with Equations 3 or Equations 3 and 5 herein and along the same axis so that an axial field generated by one coil cancels in whole or part an axial field generated by the other coil. In most applications the current directions in individual layers (i.e., rows of conductor) of double-helix coils are chosen in such a way that the transverse magnetic fields of layers add up, while the axial fields are canceled to a high degree. It is therefore customary to describe the magnetic field by two dimensional multipoles in the transverse plane. If the field changes along the X-direction, e.g. as is the case near the coil ends, a two dimensional multipole expansion can still be used to describe the field, and the multipole contents for different axial positions are determinable. In accord with Equation 3A, the multipole field components that can be generated with the resulting coil pattern correspond to the values of n for which each $A_n$ is nonzero.

In a long winding configuration, where coil end effects can be neglected, the pattern for n=1 will generate an essentially pure dipole field having no higher order components. Similarly, a quadrupole pattern (n=2), a sextupole pattern (n=3) and other even higher order patterns generate pure fields with a multipole order defined by the value of n.

Theoretically, magnetic fields of almost arbitrary shape and quality can be generated in accord with the above mathematics. However, construction of coils for generating fields with a higher multipole order (n>1) or fields containing more than one multipole order, e.g., superimposed dipole plus quadrupole fields, is limited by geometrical constraints, such as requiring a minimum spacing between conductors to avoid conductor impingement. The conductor spacing in a coil is controlled by the term h. For increasing values of h the conductors are spaced further apart along the direction of the X-axis. The minimum conductor spacing corresponds to when adjacent conductors just touch each other. Any further decrease in conductor spacing would lead to interference between neighboring conductors.

Still, even more generally, a three-dimensional space curve of a helical-shaped conductor may be generated in accord with the equations 4:

$$X(\theta)=[h/(2\pi)]\theta\pm A_n f_1(n\theta) \quad 4A$$

$$Y(\theta)=Rf_2(\theta) \quad 4B$$

$$Z(\theta)=Rf_3(\theta) \quad 4C$$

wherein $f_1$, $f_2$ and $f_3$ are arbitrary functions which may be trigonometric or numerical expressions but are not so limited.

For the illustrated embodiments $f_1$, $f_2$ and $f_3$ are as disclosed for a three-dimensional space curve according to Equations 3, i.e., for a single layer or coil row of conductor.

Also, as explained in U.S. application Ser. No. 12/061,797, "Wiring Assembly and Method of Forming a Channel in A Wiring Assembly For Receiving Conductor And Providing Separate Regions of Conductor Contact with the Channel" filed 3 Apr. 2008, referred to herein as the '797 patent, and now incorporated herein by reference, a single layer winding of the helical path contains not only a transverse field, but also an axial field component. The axial field can be canceled by adding a second layer which has the opposite tilt angle and the appropriate current direction so that the transverse fields of both layers add and the axial fields cancel. Such two-layer double-helix windings are illustrated in the cited literature. See, for example, FIG. 1 of the '797 patent. However, embodiments according to the invention are not limited to those which so add transverse fields of different layers and cancel the associated axial fields.

Figure 2:
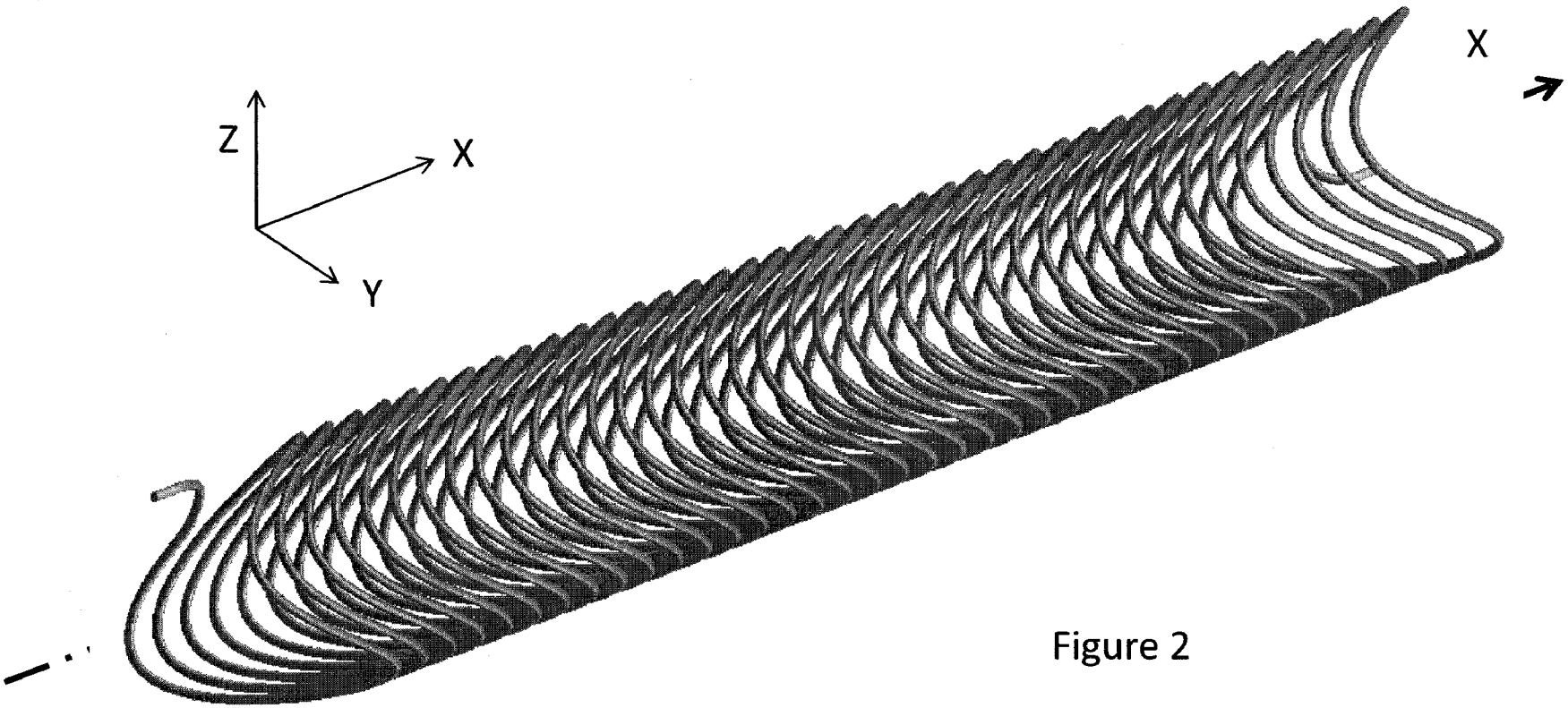
Figure 2 Prior Art
FIG. 2 is a perspective view of a prior art winding pattern showing a conductor in a helical geometry suitable for generating a quadrupole field.

The magnetic field of the double-helix winding shown in FIG. 2 can be calculated with the Biot-Savart Law. The field calculation may assume an infinitely thin filament that follows the space curve of Equations 3. Alternately, the field calculations may be based on a more complex set of assumptions to more accurately represent the field generated by the conductor shape. See U.S. patent application Ser. No. 12/133,739, filed 5 Jun. 2008, assigned to the assignee of the present invention and incorporated herein by reference. Generally, the magnetic field can be calculated for any point in space. In the past, field calculations, for which a simplistic approximation with thin filaments is used to approximate the actual conductor, has been suitable for conductors having circular shapes in cross section. That is, when the filament path follows the path of the center of the circular conductor shape, the field can be calculated at arbitrary points in space with a high degree of accuracy. Other embodiments for which field calculations may be based on a more complex set of assumptions can result in wiring configurations characterized by lower resistance, more efficient cooling and higher achievable field strength relative to former double helix designs having the equivalent coil aperture radius, R, coil length and field quality.

Embodiments of the invention are described in accord with the equations 3A, 3B and 3C, but it is to be understood that the invention is not so limited and can be practiced with conductor patterns in accord with the equations 4A, 4B and 4C. It is also to be understood that other embodiments of the invention can be based on structures having the conductor formed along a curved axis to form a helical coil as described in Ser. No. 12/133,739.

The following example embodiment of the invention is based on formation of conductor coils along a straight axis in accord with Equations 3 wherein all values of $A_n$ are zero except for $A_2$, i.e., n=2. An individual layer of a double-helix coil simultaneously generates transverse and axial magnetic fields. In most applications the direction of electrical current flow in individual rows of double-helix coils is chosen in such a way that the transverse magnetic fields of layers add, while the axial fields of different coils in a pair cancel with one another to a high degree. As described in U.S. patent application Ser. No. 12/133,760 "Conductor Assembly Having An Axial Field In Combination with Quality Main Transverse Field" filed 5 Jun. 2008 and incorporated herein by reference, not all applications of helical coils in accord with Equations 3 and 4 need be in double helix coil configurations. However, when configurations are designed to have axial fields of different coils cancel, it is customary to describe the magnetic field by two-dimensional multipoles in the transverse planes, i.e., in planes transverse to the axial direction, such as the X-direction shown in FIG. 2. If the field changes along the X-direction, a two dimensional multipole expansion can still be used to describe the field by determining the multipole content as a function of axial position.

The transverse magnetic field generated with a conductor having a regular cylindrical-shaped helical coil configuration can be described in a cylindrical coordinate system (x,R,θ) in accord with the following harmonic expansion, which describes the magnetic field in terms of dipole, quadrupole, sextupole, and higher order terms:

$$B_\theta(R,\theta) = B_{ref}\sum_{n=1}^{\infty}\left(\frac{R}{R_0}\right)^{n-1}\{b_n\cos(n\theta)+a_n\sin(n\theta)\}$$

This 2-dimensional field depends on radius R and azimuth angle θ, but is independent of the axial coordinate x. $B_{ref}$ is a reference field in Tesla, $R_0$ is the reference radius, n is the multipole order and $a_n$ and $b_n$ are the multipole components. As an example, for a pure dipole field of 5 Tesla $B_{ref}$ is 5, $b_1$ is 1 and all other $a_n$ and $b_n$ are zero, which gives:

$$B_\theta(R,\theta)=5\cos(\theta).$$

Since a dipole field is constant, there is no dependence on the reference radius $R_0$. The two components $a_n$ and $b_n$ for the same multipole order n describe the relative orientation of this multipole field, which can be "phase shifted" relative to other multipole fields. The simple trigonometric identity shows this relationship:

$$C_n\sin(n\theta+\Delta\phi)=C_n\sin(n\theta)\cos(\Delta\phi)+C_n\cos(n\theta)\sin(\Delta\phi)$$

which for a given phase angle Δϕ is equal to:

$$C_n\sin(n\theta+\Delta\phi)=A_n\sin(n\theta)+B_n\cos(n\theta)$$

For a given field the multipole components can be determined in the following way. At a given position x the field is measured at different azimuth positions at a fixed reference radius $R_o$. A Fourier analysis of the measured field values determines the multipole content of the magnetic field.

The multipole description outlined above is strictly defined for 2-dimensional fields, which only depend on the radius R and azimuth angle θ, but not on the axial coordinate x. It is convenient however, to use the same formalism for magnets having a cylindrical geometry even when their multipole configuration changes along the axis, i.e. when multipole content is dependent on the x coordinate also. In this case a Fourier analysis of field values measured on a given reference radius is performed as a function of positions x.

Quadrupole magnets (for which all values of $A_n$ are zero except for n=2) are useful for focusing charged particle beams and for separation of materials with intrinsic magnetic moments. Conventionally, focusing utilizes one or more pairs of quadrupole magnets wherein the pairs of magnets are sequentially positioned along a common axis corresponding to a desired beam path. For a double helix configuration constructed in accord with Equations 3, the common axis also corresponds to a central axis, e.g., an axis of symmetry, for each coil pair that forms a double helix configuration.

Figure 3B:
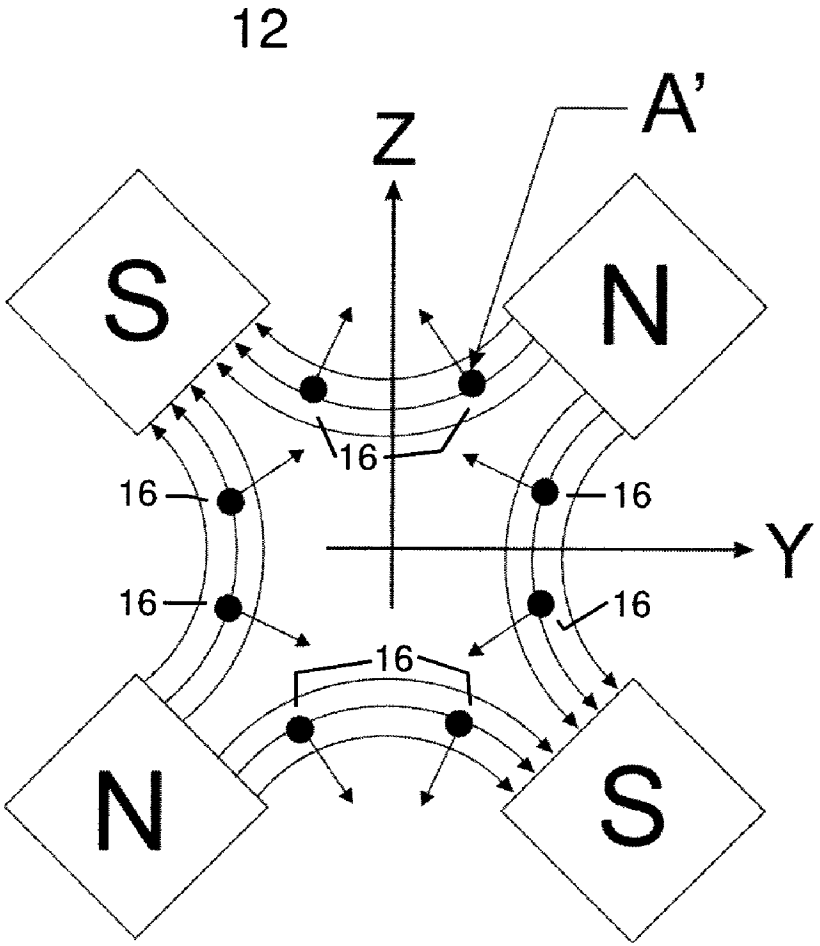
FIGS. 3A and 3B are views in cross section through central axes of two quadrupole magnets wherein one is rotated ninety degrees with respect to the other to illustrate directional movement of charged particles.
Figure 3A:
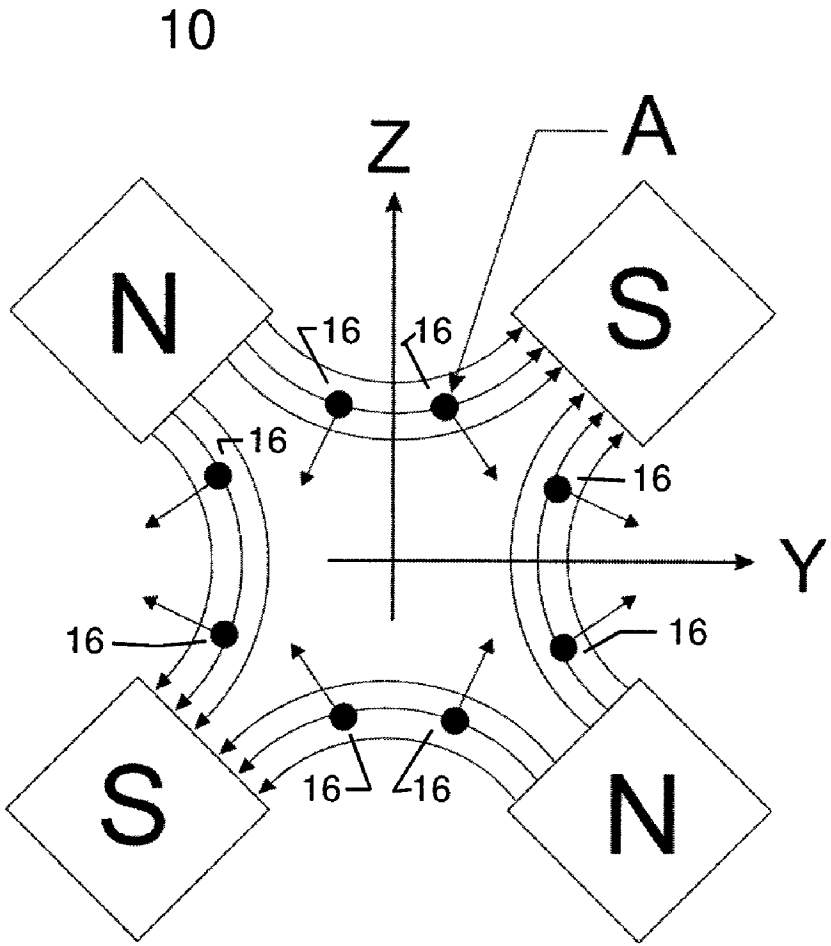

The conventional method is illustrated with the conventional quadrupole magnet 10 of FIG. 3A and the conventional quadrupole magnet 12 of FIG. 3B. The magnets 10 and 12 are placed along a common central axis, e.g., an X-axis, which is orthogonal to the illustrated Y-Z planes. Thus, the views of FIGS. 3A and 3B are each taken along a different plane extending through the common central axis. The two magnets 10 and 12 are of identical design but have different field orientations. The FIGS. 3A and 3B provide a qualitative view of associated net field lines, schematically illustrated with curved arrow lines extending between adjacent ones of the poles N and S.

In this example, the magnets 10 and 12 may be double helix designs formed with coil pairs constructed in accord with Equations 3 (with $A_n$=zero except for when n=2) wherein the axial fields generated by each coil in a pair completely cancel, and the illustrated field lines correspond to the net transverse field present within an aperture of the quadrupole magnet.

The magnet 10 of FIG. 3A differs from the magnet 12 of FIG. 3B in that the field orientations of the two magnets (as indicated by two poles N and two poles S) are rotationally shifted with respect to one another about the axial direction. This is indicated by the positioning of the poles N and S relative to the associated Y and Z axes in a common frame of reference. Specifically, all of the designated poles in the magnet 10 of FIG. 3A are rotationally shifted by ninety degrees in the Y-Z plane relative to corresponding and like designated poles in the magnet 12 of FIG. 3B. Having pairs of such quadrupole magnets 10 and 12, with the magnets in each pair having orthogonal field orientations, simultaneous beam focusing in horizontal and vertical directions can be achieved as illustrated in the figures. Exemplary beam particles 16 are shown positioned at varied locations in the aperture region of each magnet. With each particle having a velocity component along the X-axis, i.e., orthogonal to the illustrated field lines, the particles 16 in each aperture region interact with the field of the magnet. The Lorentz forces, being perpendicular to the field lines and perpendicular to the direction of a component of current traveling through the conductive coil of each magnet, act on the particles 16.

The straight arrows in FIGS. 3A and 3B indicate the directions of the acting Lorentz forces. For the magnet 10 of FIG. 3A, it can be seen that, particles like 16, spaced away from the Y-axis, are directed toward the Y-axis by the acting Lorentz forces. However, to the extent that the position of the same particle is spaced away from the Z-Axis, the Lorentz forces simultaneously direct the particle away from the Z-Axis. An exemplary particle 16 of FIG. 3A, designated A, is shown to be subject to a Lorentz force in a direction toward the Y-axis and away from the Z-axis. Such a magnet is therefore said to be focusing in the vertical direction and defocusing in the horizontal direction. The opposite is true for the magnet 12 of FIG. 3B, which is said to be focusing in the horizontal direction and defocusing in the vertical direction. The exemplary particle 16 of FIG. 3B, designated A', is shown to be subject to a Lorentz force in a direction toward the Z-axis and away from the Y-axis. Based on this intrinsic performance of quadrupole magnets, pairs of magnets must be used when focusing in both directions is required. It is well known that pairs of such assemblies of focusing and defocusing quadrupole magnets with appropriate distance between them effect a net focusing toward both the Y-axis and the Z-axis. Thus, the particles can be converged toward the X-axis as they travel through the aperture.

According to the invention, magnets and other wiring assemblies constructed in accord with Equations 3, e.g., with pairs of coil shaped conductors to effect cancellation of axial fields and addition of transverse fields, can be modified to integrate rotating field designs within a single magnet structure. For example, quadrupole magnets can be fabricated to generate a transverse field which rotates as a function of position along the central axis and thereby provides net focusing of charged particles without requiring assembly of multiple magnets as described with reference to FIG. 3. That is, it is possible to achieve net focusing of a particle beam toward the central axis of a single, continuous coil winding. This avoids junctions between segments of magnets and the associated non-uniform end fields about points of transition between associated with adjoining magnets. In some embodiments the wiring assembly can provide, as a function of position along the central axis, a sequence of field characteristics such as a quadrupole magnet, twisted along a first segment of the axis or non-twisted, followed by a dipole magnet, which in most cases would be non-twisted, followed by another twisted or non-twisted quadrupole magnet. Such a continuous winding pattern, which transitions from one multipole order to another, avoids the unwanted coil end effects of conventional saddle coil magnets. The helical winding patterns used here facilitate these transitions. Further, the winding pattern may generate variable field directions as a function of position along portions of the axis and invariant field directions along other portions of the axis.

According to one series of embodiments, a transverse field which rotates as a function of axial position, can be generated with modification to a conductor configuration of Equations 3 or 4. By applying coordinate transformations to map points X, Y, Z into points $X_P$, $Y_P$, $Z_P$, according to Equations 5, below, all points of a straight double-helix pattern are mapped into a configuration which generates a field which so rotates around the X-axis:

Equations 5

$$X_p = X \tag{5A}$$

$$Y_p = Y\cos(C\cdot\Delta X) + Z\sin(C\cdot\Delta X) \tag{5B}$$

$$Z_p = -Y\sin(C\cdot\Delta X) + Z\cos(C\cdot\Delta X) \tag{5C}$$

wherein C is a rate of twist. That is, with $\theta_{twist}$ corresponding to a displacement in the angle θ, C is a change in the angle, i.e., $\Delta\theta_{twist}$, per unit distance of advance ΔX. C may be a constant or may be a function of X, Y, Z or θ.

C, having dimensions of degrees per mm or equivalent units, determines the rate of rotational displacement of the conductor pattern around the X-axis. In one example, with C being a constant rate, the transformed position of points along the conductor path is a direct function of position along the X-axis. As an example, if a helical pattern is to be fully rotated once about the X axis over a 360 mm distance of advance, ΔX, then the rate of twist, C, is given by $$C = \frac{\Delta\theta_{twist}}{\Delta X} = \text{one degree per mm}$$

and the transformation of Equation 5 imparts a uniform twist or rotational displacement to all points along the curve of the helical pattern about the X-axis. Depending on the sign of the constant, C, the pattern may be twisted clockwise or counter-clockwise. For example, when C is positive the twist is clockwise for all positive X-coordinates and counter-clockwise for all negative X-coordinates; and when C is negative, the twist is counterclockwise for all positive X-coordinates and clockwise for all negative X-coordinates.

Figure 4:
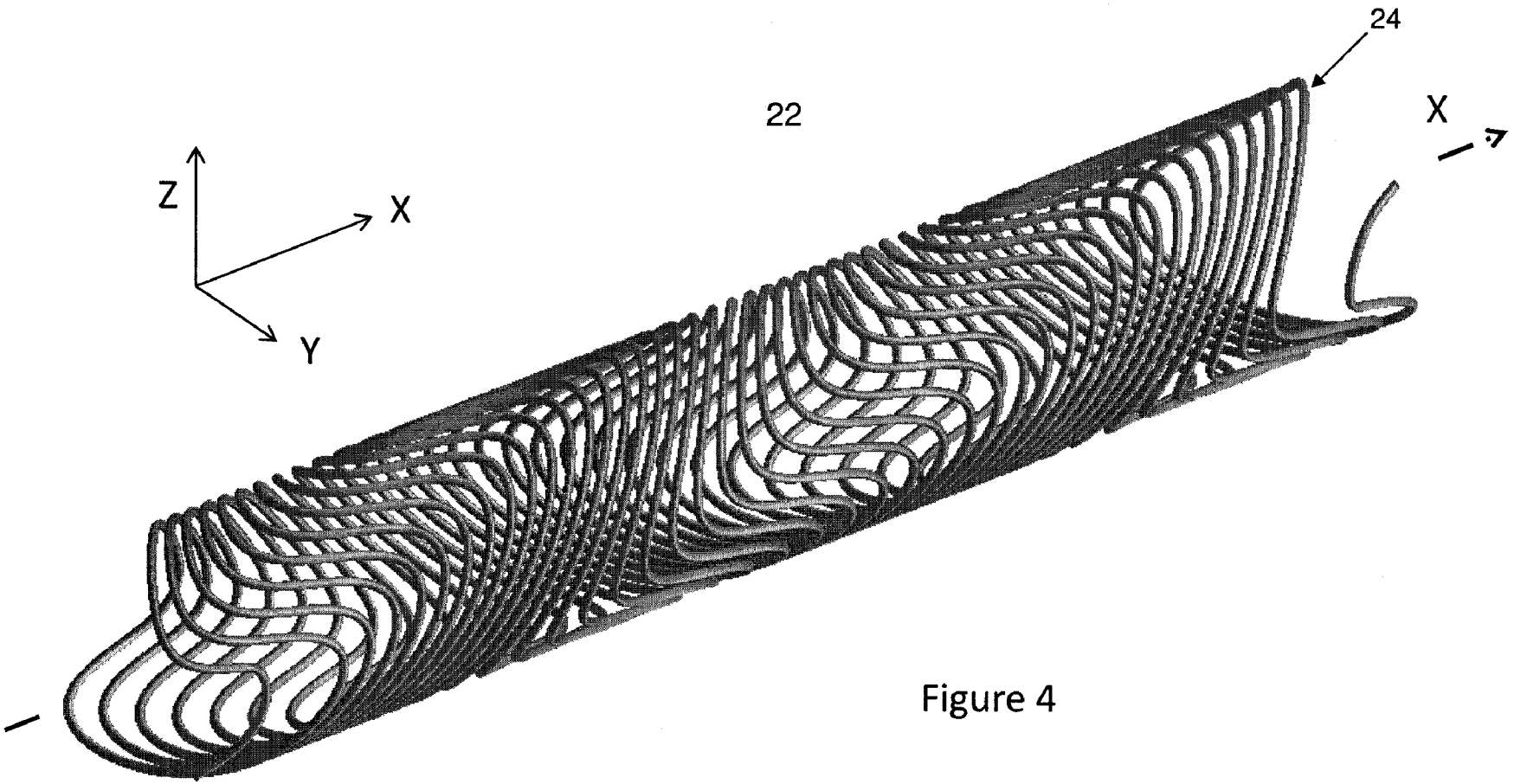
FIG. 4 is a perspective view of a winding pattern in accord with the invention wherein a transformation is applied to the pattern of FIG. 2, resulting in a conductor exhibiting a twisted quadrupole pattern.

With such a transformation in accord with Equations 5, applied to the pattern of FIG. 2, the resulting conductor pattern of the wiring assembly 22, shown in FIG. 4, has a conductor 24 exhibiting a twisted quadrupole configuration capable of generating a transverse field wherein the direction of the transverse field has a constant rate of rotation. The helical-like configuration of the wiring assembly 22 differs from that of the winding patterns shown in FIG. 2 because the repetitive pattern of the conductor 24, which for the winding of FIG. 2 has a period of 360 degrees, is transformed into a helical pattern which revolves about the X-axis as a function of advancement along the X-axis. Consequently, when the assembly 22 conducts current to generate a magnetic field, the transverse field revolves about the X-axis as a function of advancement along the X-axis.

Figure 5:
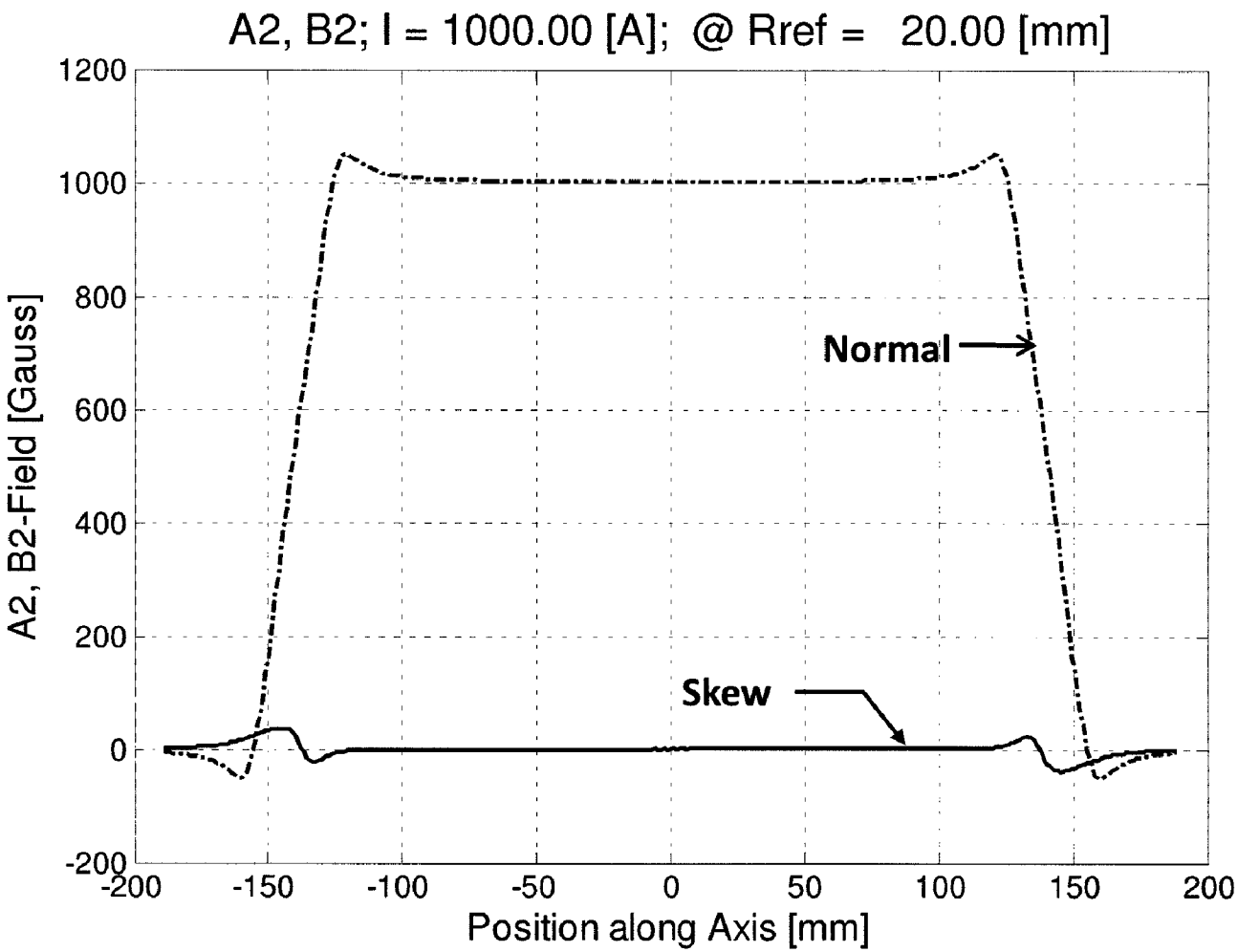
FIG. 5 illustrates a quadrupole field generated about the coil axis of the prior art winding shown in FIG. 2.
Figure 6:
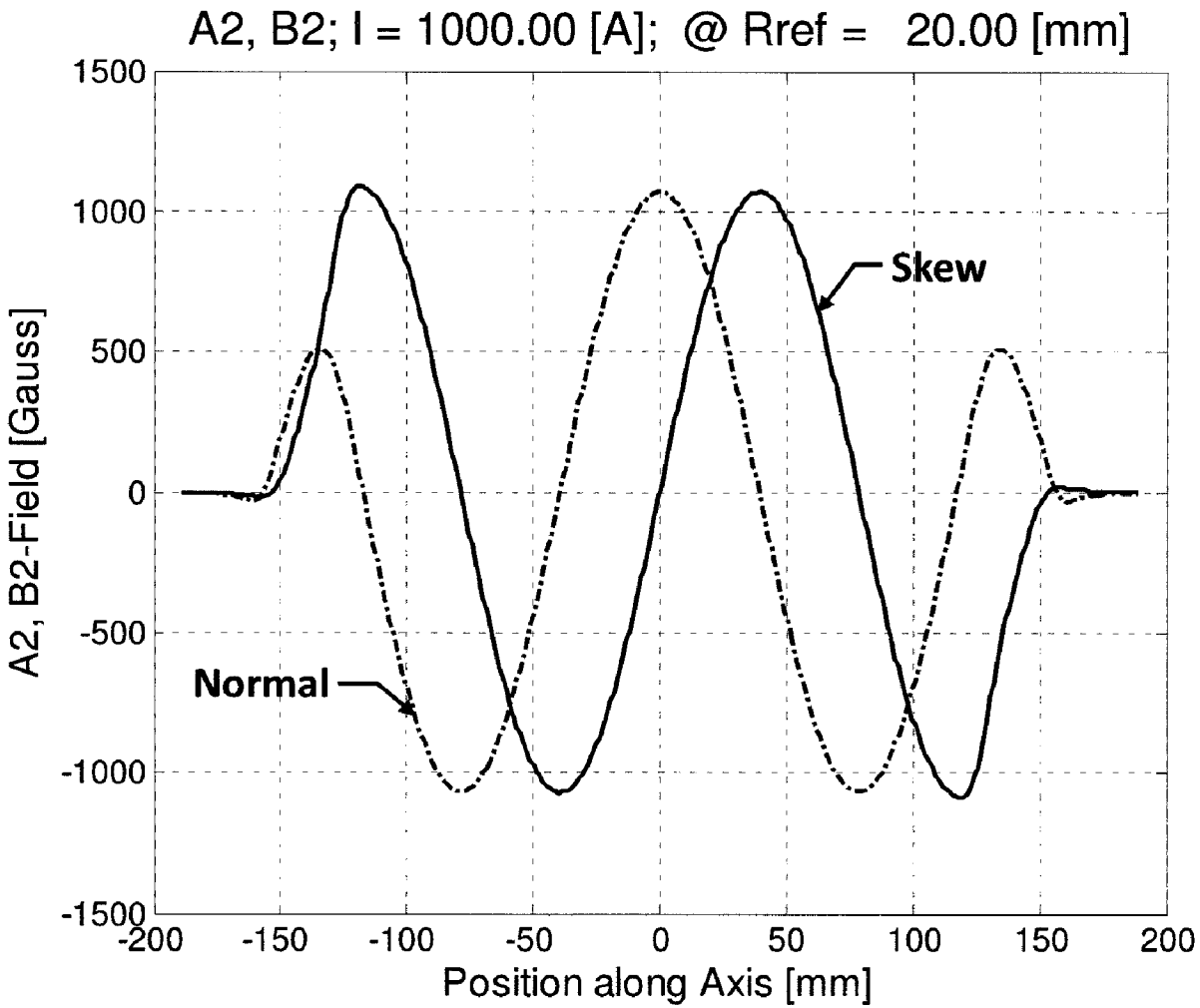
FIG. 6 illustrates a quadrupole field generated about the coil axis of the winding shown in FIG. 4.

Quadrupole fields about the coil axis (i.e., X-axis) at a reference radius of 20 mm (80% of the coil aperture radius) for the straight quadrupole configuration of FIG. 2 and the twisted quadrupole configuration of FIG. 4 are shown in FIG. 5 and FIG. 6, respectively. The quadrupole field calculated about the coil axis at a reference radius of 20 mm resulting from the coil of FIG. 2 is shown in FIG. 5 to generate an approximately constant normal quadrupole over the full length of the coil with field intensity falling off near the ends. The skew quadrupole component is approximately zero with small deviations from zero near the coil ends.

The quadrupole field of the coil having the transformed (twisted) helical pattern, illustrated in FIG. 4, is shown in FIG. 6. As can be seen the direction of the quadrupole field changes as a function of position along the coil axis. In reference to the charged particle focusing illustrated in FIG. 3, it can be understood that this coil configuration shows some focusing of a charged particle beam in all directions over the full length of the coil.

Integrating focusing and defocusing winding configurations into continuous configurations would be of great interest to Fixed Field Alternating Gradient (FFAG) accelerators which are currently considered for carbon therapy facilities.

Coordinate transformation according to Equations 5 is not only applicable to quadrupole conductor assemblies, e.g., focusing or defocusing winding patterns, but can also be applied to numerous other wiring assemblies, including dipole and sextupole patterns and combined function magnets.

Twisted dipole configuration, known to the experts in the field as "Siberian Snakes", are used in accelerators to maintain polarization of the beams, i.e., to keep the spin orientations of the beam particles aligned. The Relativistic Heavy Ion Collider (RHIC) at Brookhaven National Laboratory has used twisted saddle coils for this application. Using the technique described in this document, would significantly simplify manufacturing of such twisted dipole magnets.

In a combined function magnet the wiring patterns according to Equations 3 can comprise multiple pairs of double helix windings over one another wherein different pairs are patterns according to different values of n. As one example, a first double helix pattern may result in a quadrupole magnet having no axial field component and a second double helix pattern formed about the first pattern may result in a dipole magnet also having no axial field component. The dipole field used for beam steering would be left untwisted in most applications while the quadrupole field may have a constant rate of twist, C.

As noted above, the parameter, C, in Equations 5 does not have to be a constant, and can have any dependence on the coordinates (x, y, z) of a given pattern or a direct dependency on θ. Furthermore, the multipole order, n, of the configuration can depend on the coordinate X. For example, a wiring assembly with $n \geqq 2$ can have a variable rate of twist along a straight axis X, followed by a bent section with n=1 (steering dipole) and C=0, followed by a straight section with $n \geqq 2$ and constant or variable twist rate C. Such embodiments are relevant to charged particle beam lines, wherein, for example, a magnet configuration consists of a focusing quadrupole field, followed by sections for generating dipole bending fields, followed by further focusing fields.

Figure 7:
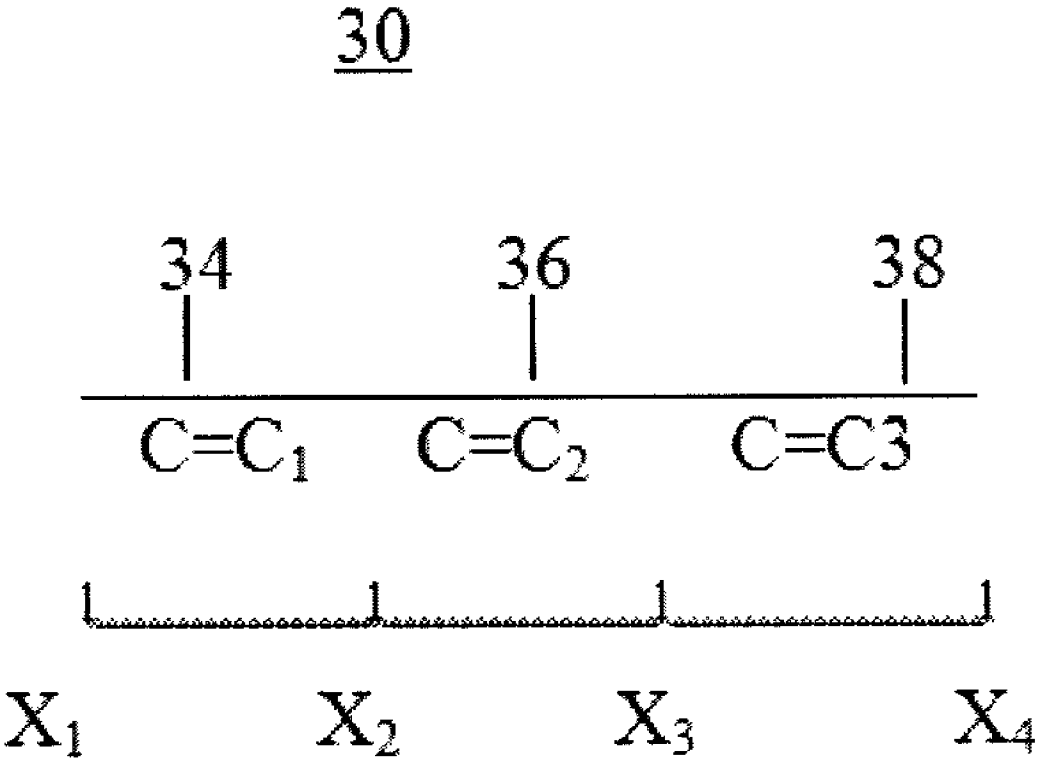
FIG. 7 illustrates in schematic form a wiring assembly according to an embodiment of the invention.

In another example FIG. 7 schematically illustrates a wiring assembly 30 having a variable rate of twist, C, along an axis X. A first region 34 having a first pattern extends a first distance along the X-axis, e.g., between $X_1$ and $X_2$, with $C=C_1$; and then an adjacent second region 36 having a second pattern extending a second distance along the X-axis, e.g., between $X_2$ and $X_3$, has no twist ($C_2=0$), and then a third region 38 having a third pattern, extending a third distance along the X-axis, e.g., between $X_3$ and $X_4$, with $C=C_2$. The first and third regions 34 and 38 have twisted patterns relative to Equations 3 or 4, e.g., per Equations 5. $C_1$ and $C_3$ may each be a function of X. The patterns of regions 34, 36 and 38 may be combinations of functions in accord with equations 3 or 4 and 5 wherein two or more values of $A_n f_1(n\theta)$ or, more generally, $A_n f_1(n\theta)$, are non-zero terms.

The second and third regions 36, 38 may be, respectively, a dipole pattern suitable for steering the beam and a quadrupole pattern. In embodiments not shown, a combined function magnet configuration consists of a coil pair providing both a focusing quadrupole field and a defocusing quadrupole field, while a dipole field may be generated in a separate pair of windings positioned along the same axis, e.g., between $X_2$ and $X_3$. In another embodiment, a conductor pattern may begin as a focusing quadrupole pattern, then transition to a dipole pattern and then transition to a defocusing quadrupole pattern.

Using the technique described above, such transitions can be realized without having abrupt coil end terminations between cells, e.g., as when individual quadrupole and dipole magnets are being used. In the past, coil ends have typically had very complex multipole content. These unwanted effects, which complicate the particle beam optics of such cells, can be avoided by integrating different orders of multipoles in a single wiring assembly wherein multipole orders are sequentially transitioned as a function of position along the central axis.

Although not limited to magnets based on double-helix technology, fabrication of winding configurations which generate rotatable transverse fields can be readily achieved with single helix and double-helix windings. As described in above-referenced co-pending U.S. patent application Ser. No. 12/061,813 to form such helical-like configurations (in accord with Equations 3) conductor may be placed in grooves that are precisely machined in cylindrical support structures, e.g., with computer-controlled CNC machines. To generate patterns with desired transformations in accord with Equations 5, the same machining technology can be applied to generate twisted coil geometries as is used for unmodified helical coil patterns. The embodiment described above can be used for normal conducting and superconducting coils.

By way of example and not limitation, superconducting twisted coils can be built with superconducting wire or cable by cutting a groove of appropriate width and depth into a support cylinder and placing superconductor in the groove. See, again, Ser. No. 12/061,813. The same approach can be used for normal conducting wire, but it is also possible to start with a conductive cylinder or a cylinder having a conductor layer formed thereon in which a fully penetrating groove is cut through the layer. See, for example, the above-referenced application Ser. No. 12/388,306. In such processes the remaining conducting material forms a continuous conductive path which generates essentially the same field configuration. Due to the varying width of the conductive path generated this way, such coils can offer lower resistance than coils made with normal conducting wire. Large conductor cross sections can also be easily realized with this approach, as no bending or other forming of conductor is necessary.

Some embodiments of the invention are based on transformations of double helix winding configurations described in the '042 Patent, but other winding geometries may vary from turn-to-turn and from layer-to-layer to achieve desired field configurations and field quality characteristics. See Ser. No. 12/061,813 and Ser. No. 12/388,306. The term "turn-to-turn" as used herein is in the context of a adjacent turns or loops in sequence of loops or revolutions in a winding of conductor. Embodiments for fabrication methods and structures disclosed in Ser. No. 12/061,813, refer to winding of the conductor about an insulative layer or core, followed by formation of another insulative layer thereover, and subsequent placement of another conductor thereon. That is, a sequence of repetitive forming of an insulative layer, followed by placement of conductor along a machined path in each insulative layer, may be used to fabricate wiring assemblies according to the invention, this resulting in a layer-over-layer structure. Alternately, methods described in Ser. No. 12/388,306 may be applied to fabricate a wiring assembly according to the invention. In all cases, the winding patterns may vary from turn-to-turn and/or from layer-to-layer to achieve desired field configurations and field quality characteristics. Such variations can be had by exercising, for example, optimization procedures, which are known to suppress systemic errors, improve field uniformities and suppress unwanted multipole components. To effect such optimizations, field calculations may be performed on partially fabricated structures such that if undesirable field characteristics are detected these can be offset by introducing modulations in a conductor pattern associated with a subsequently formed layer. See the above-referenced Ser. No. 12/133,760.

While the invention may be implemented with superconducting materials formed in thin sheets or tube shapes, in other embodiments high temperature superconductors like YBCO can be used in the invented process by directly depositing layers of the material on appropriate substrate material as used in the manufacturing of tape conductors of the same superconductor. In such applications multi-layered coils can be manufactured with a very small radial build-up, e.g., minimum coil diameter, since the conductor layers of superconductors like YBCO are typically only 1 or 2 microns thick. Such embodiments are useful for high temperature superconductors which, being of a brittle nature, have limitations in achievable bending radii.

Also, because some embodiments of wiring assemblies may have the conductor formed in-situ with a material removal process, the invention allows for accommodation of very "large" conductors, i.e., having large cross sections, without encountering many of the difficulties which might result from conforming a wire into a helical pattern. On the other hand, very small and fine line geometries for coil configurations can be attained via, for example, an etching or laser removal process. Embodiments of the invention are not limited to forming helical coil shapes about an axis of symmetry. Numerous variations may be had in accord with the examples provided in the several documents incorporated herein by reference.

Figure 10:
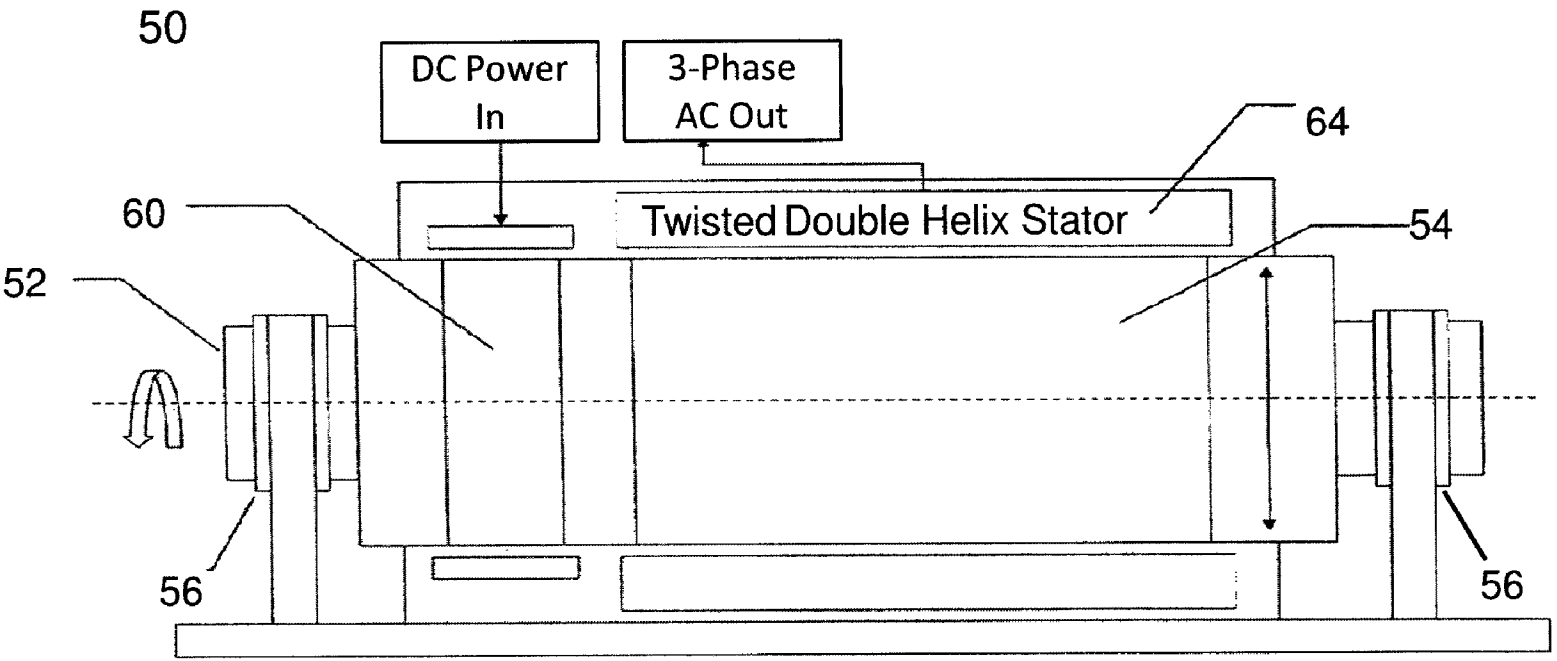
FIG. 10 illustrates in schematic form a high RPM electrical machine system according to an embodiment of the invention.

FIG. 10 illustrates a high RPM electrical rotating machine system 50 formed in accord with the invention. The system 50 includes numerous conventional components as illustrated in the figure, including a shaft 52, air bearings 56, and a brushless exciter 60. The stator-rotor combination is shown in FIG. 10 and in the partial cut-away view of FIG. 8. The rotor 54 is mounted on the shaft 52 for rotational movement with respect to a stator 64 positioned thereabout. A backiron shield 66 is shown positioned about the stator 64. The rotor 54 and the stator 64 may both be Direct Helix designs. The stator is a three-phase twisted double helix design in accord with Equations 3 and 5 wherein $A_n$=0 for all values of n except n=2. The rotor 54 of FIG. 8 comprises a double helix coil pair 70 which has the same or nearly the same twist and the same multipole order as the stator 64. Each coil row includes a plurality of open loops 71 which may be fewer than 10 or more than 100. The illustrated twisted helical pattern of the rotor 54 is shown to include 46 loops wherein the quadrupole pattern revolves along the loops 71 instead of repeating every 360 degrees.

The wiring pattern of the outer member of the coil pair is shown along a surface of the rotor 54. The stator 64 comprises three pairs of double helix coil rows 72, 74 and 76. Each of the coil row pairs 72, 74 and 76 is formed in a quadrupole pattern like that shown in FIG. 4. With reference to the view in cross section of FIG. 9, the three phase stator 64 comprises the three pairs of coil rows 72, 74, 76 wherein coils A, A' are members of the pair 72, coils B, B' are members of the pair 74 and coils C, C' are members of the pair 76. Each coil row pair provides a phase excitation positioned at a 120 degree rotational spacing relative to the other pairs. For a motor application, each pair of coil rows may be independently connected to a different power source, and the power introduced to each pair may be 120 degrees out of phase with respect to the two other sources.

Because each coil row of the stator 64 is concentrically positioned over another layer, the magnetic field generated by each layer is progressively further from the rotor field as a function of distance of the stator layer from the rotor. In order for each phase to provide an equivalent radial position of the resultant magnetic field experienced by the rotor, the individual members of each coil pair are shown positioned such that the average distance between each member of the pair is at the same position relative to the rotor. See, again, FIG. 9. As a result, the layers (i.e., coil rows) are ordered in the following sequence: A-B-C-C'-B'-A'. Accordingly, for a stator having three pairs of double helix coils, the coils in one or more pairs are placed radially inward and outward with respect to at least one other pair. For example, the coil B' is positioned radially inward with respect to the coil pair CC' and the coil B is positioned radially outward with respect to the coil pair CC'. More generally, a three-phase stator may comprise many multiples of the illustrated three pairs of coil rows (A,A'), (B,B') and (C,C') with members in pairs positioned radially inward and radially outward with respect to one or more other pairs.

Figure 9:
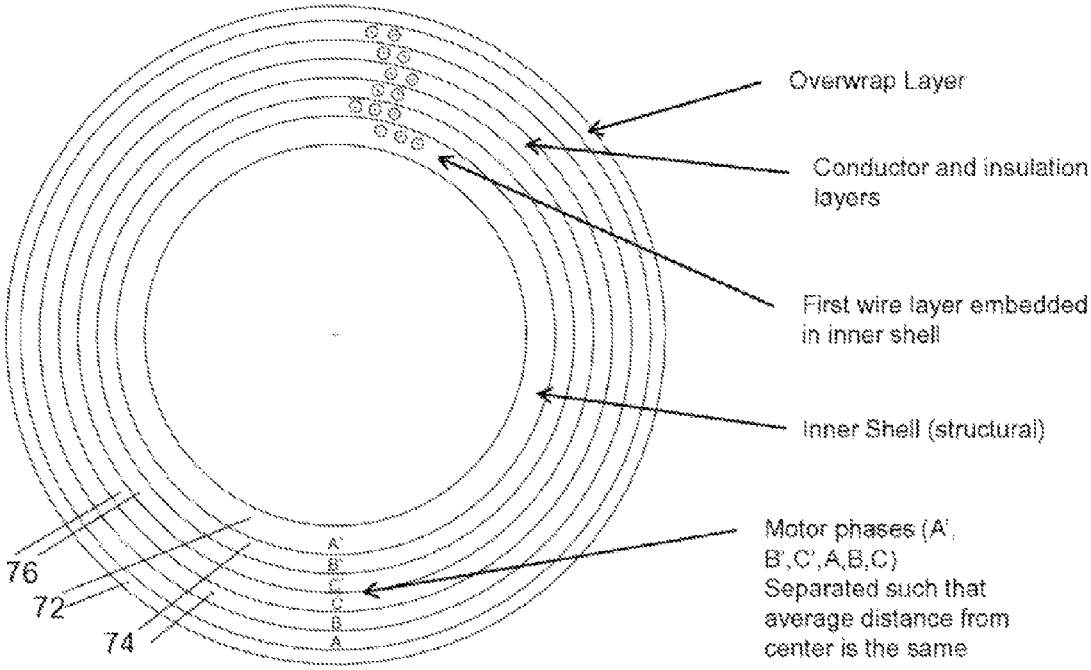
FIG. 9 is a view in cross section of a stator incorporating features of the invention.

Although a rotor may comprise a single DH coil row pair, other embodiments may include multiple pairs in arrangements analogous to what is illustrated in FIG. 9 for the stator, such that many pairs of coil rows are positioned in the rotor. Additional coil row pairs may also be provided in the stator. Generally, the aforedescribed arrangements for multiple stator and rotor coil rows equalize the mutual inductance, i.e., flux sharing, between the rotor and stator coils.

The intrinsic high field uniformity of double helix coil rows compared to conventional windings simplifies design for optimal magnetic flux transfer. In the case of a generator, the high field uniformity minimizes output voltage harmonic distortion. Minimal undesired harmonics also minimizes vibrations and vibration-induced stress.

Using the double helix technology in accord with Equations 3 enables a continuous winding in one layer to create any number of poles. This provides a number of advantages such as simplified construction, resulting in reduced manufacturing cost and improved system performance due to the continuous nature of the pole transitions.

Figure 8:
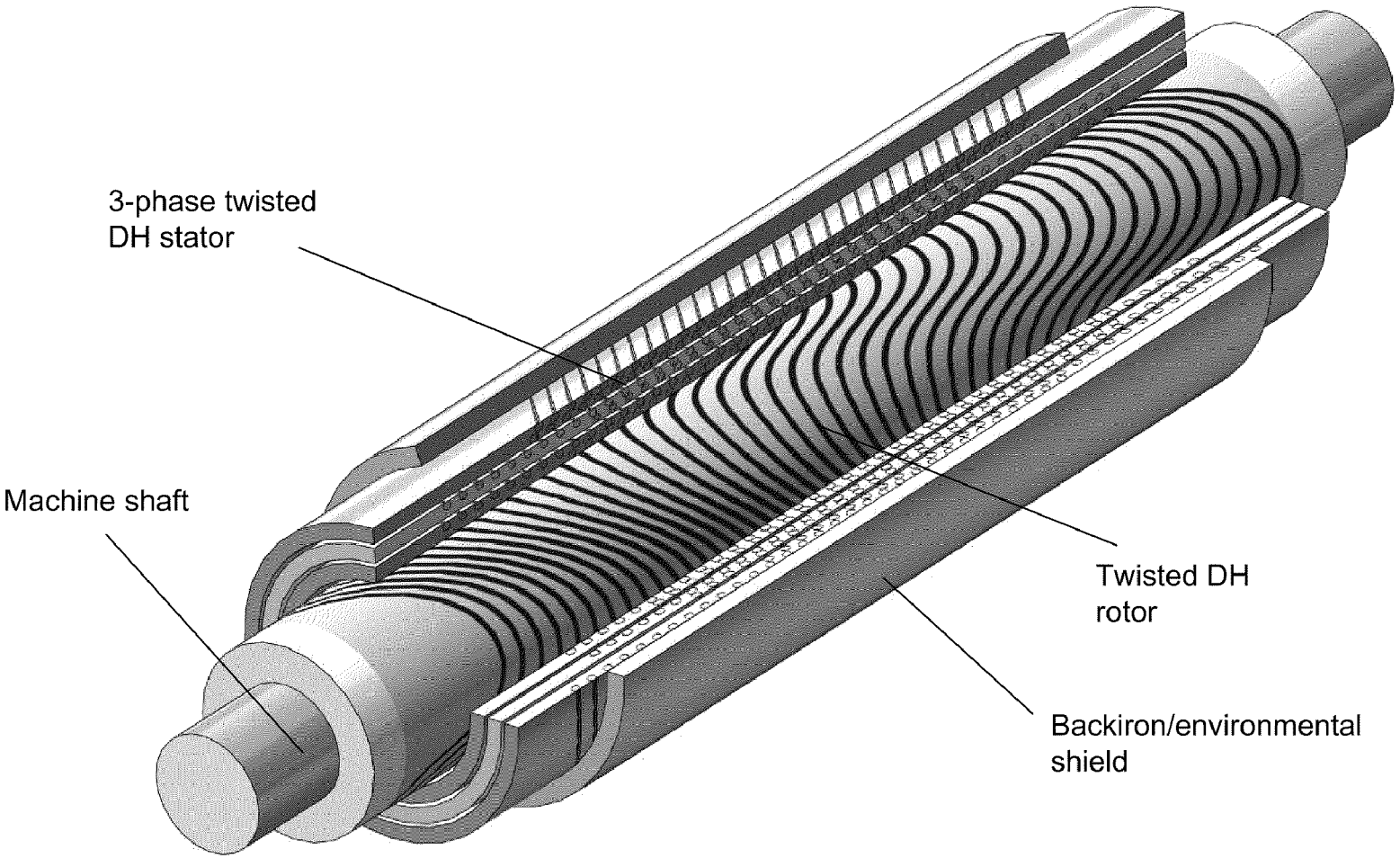
FIG. 8 is a perspective view of a rotor stator combination incorporating features of the invention.

In the example of FIGS. 8-10, the multipole order for the rotor and stator windings is identical. Other embodiments include twisted multipole fields of higher orders for the rotor and stator windings. With the same twist rate C applied to the both stator and rotor winding patterns, that the phase angle difference between the interacting rotor and stator fields is constant along the axis of the machine.

Use of twisted multipole patterns in electrical machinery modifies the stress distribution due to the electromagnetic torque in the rotor and stator assemblies and forces are not concentrated in a straight line parallel to the machine axis. Twisted windings stabilize the rotor in the axial direction counteracting any axial forces. Slight differences in the twist parameter C of the rotor and stator windings would decrease the electromechanical stiffness of the machine, which, may be useful in some applications.

Although example embodiments have been described, numerous other designs and methods of manufacture will be apparent. For example, for embodiments having grooves formed in bodies having cylindrical shapes, there may be an outer insulative surface (such as an anodization, a deposited coating or other material) along the shape under which the conductive layer resides. The insulative surface may be formed prior to or after the groove is formed in the shape.

While the invention has been described with reference to particular embodiments, it will be understood by those skilled in the art that various changes may be made and equivalents may be substituted for elements thereof without departing from the scope of the invention. For example, although coils have been shown to be symmetric about a straight or curved axis, numerous ones of the disclosed features can be advantageously applied in other applications such as wherein the axis is generally asymmetric. Although an example system comprising electrical machinery has been described, to which concepts according to the invention may be applied, numerous other systems will benefit from the invention, including Fixed Field Alternating accelerators.

The scope of the invention is only limited by the claims which follow.

The claimed invention is:

1. A conductor assembly, comprising:

a length of continuous conductor positioned about an axis in a helical-like configuration to provide a sequence of interconnected and overlapping coil turns, each turn corresponding to a different segment of the conductor and extending a full turn about the axis, with a first coil turn in the sequence overlapping a second coil turn in the sequence and entirely displaced in one direction along the axis relative to the second turn, wherein:

the configuration of the conductor being such that, when conducting current, a magnetic field is generated or, when the conductor is in the presence of a changing magnetic field, a voltage is induced therein, and the first and second coil turns are conductor segments each extending at least 360 degrees about the axis, with the first and second coil turns connected to one another in series without any intervening segment of conductor positioned between them, thereby forming two consecutive and continuous coil turns extending at least 720 degrees about the axis; and the assembly having an aperture region extending within and through open loops of the first and second coil turns and along the axis, wherein the configuration of the conductor enables generation of a transverse field along each of a plurality of planes passing through the axis and orthogonal to the axis, and wherein direction of the transverse field generated by two or more consecutive full turns about the axis rotates about the axis as a function of position along the axis.

2. The assembly of claim 1 wherein the direction of the transverse field rotates about the axis as a function of position along the axis.

3. The assembly of claim 1 further comprising a second continuous conductor also positioned in a helical-like configuration about the axis, forming a double helix coil, to generate an axial field which cancels an axial field component generated by the other continuous conductor.

4. The assembly of claim 1 wherein the conductor comprises a sequence of ten or more interconnected and overlapping coil turns, each turn corresponding to a different segment of the conductor and extending a full 360 degree turn about the axis, with each coil turn in the sequence overlapping an adjoining coil turn in the sequence and entirely displaced in one direction along the axis relative to the adjoining turn.

5. The assembly of claim 1 wherein, with reference to an X, Y, Z coordinate system having an X-axis, a Y-axis and a Z-axis, the conductor having the helical-like configuration includes a plurality of adjoining coil turns around the X-axis, each coil turn having an advance per 360 degree turn along the X-axis, the coil turns forming a continuous sequence of loops about the X-axis according to a series of point transformations from X, Y, Z to points $X_P$, $Y_P$, $Z_P$, based on $$X(\theta) = [h/2\pi]\theta + \sum_{n=1}^{\infty} A_n \sin(n\theta + \Phi_n)$$

$$Y(\theta) = R\cos(\theta)$$

$$Z(\theta) = R\sin(\theta)$$

wherein:

h is the advance per 360 degree turn along the X-axis,

θ is an azimuthal angle measured in a first plane transverse to the X-axis,

R corresponds to a radial distance from the X-axis to a point along the coil turns, and $A_n \sin(n\theta+\phi_n)$ is a modulating component which imparts a positive or a negative tilt to the turns relative to the first plane in proportion to $A_n$, with $\phi_n$ determinative of phase shifts of sinusoidal components, wherein $$X_p = X$$

$$Y_p = Y\cos(C\cdot\Delta X) + Z\sin(C\cdot\Delta X)$$

$$Z_p = -Y\sin(C\cdot\Delta X) + Z\cos(C\cdot\Delta X)$$

and wherein C is an angular rate of displacement about the axis so that points which could form a pattern in accord with X(θ), Y(θ) and Z(θ) instead form a pattern which rotates around the X-axis.

6. The assembly of claim 1 wherein the axis about which the conductor is formed is a straight axis.

7. An assembly comprising a conductor positioned about an axis in a helical-like configuration to provide a sequence of coil turns each having a pattern which varies as a function of rotational angle about the axis with respect to a reference angle about the axis, each coil turn partially overlapping an adjoining coil turn in the sequence, first and second coil turns in the sequence being conductor segments each extending 360 degrees about the axis from the reference angle, the first and second coil turns connected to one another in series without any intervening segment of conductor positioned between them, thereby forming two consecutive and continuous coil turns wherein, with respect to the reference angle the patterns of the first and second coil turns differ from one another as a function of angle of rotation from the reference angle.

8. The assembly of claim 7 wherein, when a current passes through the conductor, a transverse field is generated in directions orthogonal to the axis with direction of the transverse field varying about the axis as a function of position along the axis.

9. The assembly of claim 8 wherein, when a current passes through the conductor, the direction of the transverse field rotates about the axis as a function of position along the axis.

10. The assembly of claim 7 configured as a rotating machine having a stator and a rotor operatively positioned to generate a magnetic field or induce a voltage, wherein the stator and rotor each comprise a conductor positioned about an axis in a helical-like configuration to provide a sequence of coil turns, with each coil turn partially overlapping an adjoining coil turn in the sequence, wherein the configuration includes a periodic pattern which rotates about a portion of the axis as a function of position along the axis.

11. The assembly of claim 10 characterized in that when a current passes through one of the conductors, a transverse field is generated in directions orthogonal to the axis about which that conductor is positioned with direction of the transverse field varying about the axis about which that conductor is positioned as a function of position along the axis.

12. The assembly of claim 10 characterized in that:

when a current passes through the conductor of the stator, a transverse field is generated in directions orthogonal to the axis about which that conductor is positioned with direction of the transverse field varying about the axis about which that conductor is positioned as a function of position along the axis; and when a current passes through the conductor of the rotor, a transverse field is generated in directions orthogonal to the axis about which that conductor is positioned with direction of the transverse field varying about the axis about which that conductor is positioned as a function of position along the axis.

13. A conductor assembly comprising a layer and a conductor positioned in a path formed in the layer, with the path revolving about an axis in a helical-like configuration to provide a sequence of coil turns each having a pattern is formed in the conductor path which pattern rotates about the axis as a function of angle about the axis with respect to a reference angle, wherein:

the sequence includes first and second coil turns, each extending 360 degrees of rotation about the axis from the reference angle;

the first and second coil turns are connected to one another in series without any intervening segment of conductor positioned between them, thereby forming two consecutive and continuous coil turns: and the patterns of the first and second coil turns differ from one another as a function of angle of rotation from the reference angle.

14. The assembly of claim 13 wherein, when a current passes through the conductor, a transverse field is generated in directions orthogonal to the axis such that the direction of the transverse field rotates about the axis as a function of position along the axis.

15. The assembly of claim 14 wherein, along a series of points on a portion of the axis, the transverse field rotates about the axis at a constant rate in proportion to change in position of the conductor path along the axis.

16. The assembly of claim 10 wherein the stator comprises a plurality of pairs of conductors in a helical-like configuration wherein members of each pair have opposite tilt angles to substantially cancel axial field components so that when conducting current the assembly predominantly generates only axial field components.

17. A conductor assembly comprising a first conductor, the assembly being of the type such that (i) when conducting current, a magnetic field is generated or (ii) when the conductor is in the presence of a changing magnetic field, a voltage is induced therein, the conductor positioned about an axis in a helical-like configuration to generate a magnetic field pattern including one or more magnetic field components in directions transverse to the axis which each rotate about the axis as a function of position along the axis, the conductor configured as a repetitive pattern which rotates around the axis, wherein the first conductor is arranged, with reference to an X, Y, Z coordinate system having an X-axis, a Y-axis and a Z- axis, in a series of 360 degree coil turns forming a helical-like configuration to provide a repetitive coil pattern which rotates around the X-axis, said repetitive pattern being of the form $$X(\theta)=[h/(2*\pi]\theta+\Sigma A_n\sin(n\theta+\phi_n)$$

$$Y(\theta)=R\cos(\theta)$$

$$Z(\theta)=R\sin(\theta)$$

wherein:

h is determinative of an advance of each coil turn along the X-axis,

θ is an azimuthal angle measured in a Y-Z plane parallel to the Y-axis and the Z-axis and transverse to the X-axis, R corresponds to a radial distance from the X-axis to a point along one of the coil turns, and $\Sigma A_n$, $\sin(n\theta+\phi_n)$ is a modulating component which imparts a positive or a negative tilt to the turns relative to the Y-Z plane in proportion to $A_n$, with $\phi_n$ determinative of phase shifts of sinusoidal components.

18. The assembly of claim 17 wherein the conductor assembly comprises a second conductor wherein the first and second conductor are arranged in a double helix coil configuration where axial fields generated by different conductors have a canceling effect.

19. A conductor assembly comprising a magnetic coil positioned about an axis, the assembly being of the type which, when conducting current, generates a magnetic field or which, in the presence of a changing magnetic field, induces a voltage, the coil including a conductor occupying a spiral-like configuration around the axis capable of generating a field transverse to the axis when current flows through the conductive material, wherein:

the spiral-like configuration includes a section of continuous conductor forming a first continuous sequence of loops about the axis according to a series of point transformations from X, Y, Z to $X_P$, $Y_p$ and $Z_p$ based on $$X(\theta) = [h/2\pi]\theta + \sum_{n=1}^{\infty} A_n\sin(n\theta + \Phi_n)$$

$$Y(\theta)=R\cos(\theta)$$

$$Z(\theta)=R\sin(\theta)\text{wherein,}$$

h is determinative of an advance per loop along the axis,

R corresponds to a radial distance from the axis to a point along the configuration, θ is an azimuthal angle measured in a plane transverse to the axis, $A_n \sin(n\theta+\phi_n)$ is a modulating component which imparts a positive or a negative tilt to the turns relative to a plane transverse to the axis in proportion to $A_n$, wherein the points $X_P$, $Y_p$ and $Z_p$ describe the conductor path in the coil according to a rotation about the axis of each point in the Y-Z plane by an angle proportional to a displacement along the axis, the transformation in accord with $$X_p=X$$

$$Y_p=Y\cos(C\cdot\Delta X)+Z\sin(C\cdot\Delta X)$$

$$Z_p=-Y\sin(C\cdot\Delta X)+Z\cos(C\cdot\Delta X)$$

wherein C is an angle of rotation per unit distance of advance, ΔX, along the axis.

20. A conductor assembly comprising a magnetic coil positioned about an axis, the assembly being of the type which, when conducting current, generates a magnetic field or which, in the presence of a changing magnetic field, induces a voltage, the coil having a spiral-like configuration, including a series of turns about the axis which advance along the axis, the assembly generating a field transverse to the axis when current flows through the coil wherein, with reference to an X, Y, Z coordinate system having X, Y and Z axes:

the configuration is a periodic pattern spiraling about the X-axis with features including:

an X dependence on $[h/(2*\pi)]\theta \pm$ and $A_n f_1(n\theta)$ a Y dependence on $Rf_2(\theta)$ and a Z dependence on $Rf_3(\theta)$, with the pattern having a monotonically increasing phase shift about the axis as a function of distance along the axis, wherein:

$f_1$, $f_2$ and $f_3$ are periodic functions;

n is a number greater than zero;

h determines an advance per turn along the X-axis,

θ is an azimuthal angle measured in a first plane transverse to the X-axis,

R corresponds to a radial distance from the X-axis to a point along the coil, and $A_n$ is a non-zero term which imparts a positive or a negative tilt to the turns relative to the first plane.

21. The assembly of claim 20 wherein the spiral-like configuration includes a section of continuous conductor forming a first continuous sequence of loops about the central axis according to the following equations:

$$X(\theta)=[h/(2\pi)]\theta\pm\Sigma A_n f_1(n\theta)$$

$$Y(\theta)=Rf_2(\theta)$$

$$Z(\theta)=Rf_3(\theta)$$

for n>0.

* * * * *